US005720575A

United States Patent [19]

Henrie

[11] Patent Number: 5,720,575

[45] Date of Patent: Feb. 24, 1998

[54] WATER CONTROL AND DIVERSION HEADGATE AND METHOD OF MANUFACTURE

[76] Inventor: James O. Henrie, 959 Lizzie La., St. George, Utah 84790

[21] Appl. No.: 559,609

[22] Filed: Nov. 20, 1995

[51] Int. Cl.[6] ..... E02B 7/26; E02B 13/00

[52] U.S. Cl. ..... 405/104; 405/103; 405/90; 405/39; 405/36

[58] Field of Search ..... 405/36, 39, 49, 405/87, 90, 104, 124, 103; 138/121, 173

[56] References Cited

U.S. PATENT DOCUMENTS

| | | | |
|---|---|---|---|
| 1,054,103 | 2/1913 | Force | 405/104 X |
| 1,143,351 | 6/1915 | Benson | 405/104 X |
| 3,926,222 | 12/1975 | Shroy et al. | 405/49 X |
| 4,261,671 | 4/1981 | Langner | 138/173 X |
| 4,303,104 | 12/1981 | Hegler et al. | 138/173 X |
| 4,950,103 | 8/1990 | Justice | 405/43 |

*Primary Examiner*—Tamara L. Graysay
*Assistant Examiner*—Frederick L. Lagman

[57] ABSTRACT

A water control and diversion headgate for use in irrigation systems, simplifying the headgate construction, easing its operation and improving its overall efficiency. This headgate includes a corrugated pipe, sometimes provided with an internal liner and having a beveled slot which extends slightly less than halfway through its diameter. A solid, flat elongated water-blocking gate, usually somewhat flexible, is positioned within the slot for vertical movement and for fully or partially blocking water flow through the pipe. The gate has a tapered lower edge and is adapted to make a sealing line contact with an adjacent pipe corrugation for sealing efficiency.

15 Claims, 2 Drawing Sheets

WATER CONTROL AND DIVERSION HEADGATE AND METHOD OF MANUFACTURE

TECHNICAL FIELD

This invention relates to a new and improved headgate for diverting or controlling the flow of water, particularly during the irrigation of agricultural land, and to a method of manufacturing and assembling the same. The headgate is equally as useful for diverting water in either small or relatively large irrigation channels.

BACKGROUND ART

Subsequent to the original use of plain earthen dams for diverting water from one channel to one or more other channels, the utilization of control gates in ditches, channels or canals for diverting the direction and controlling the quantity of water flowing therethrough has become a standard practice. Such devices define the heart, or the central members, of most open channel irrigation systems within the agricultural industry.

Water diversion control gates used both in the past and in current practice have, in most cases, been constructed from wood, metal or concrete. Such gates, in consequence of being complicated in design and construction, have also been more expensive than is desirable for normal farming operations, thus limiting their use.

These prior art water control or diversion gates, or headgates, are usually fabricated, for example, by using metal or concrete pipe of appropriate diameter as the primary component through which the water flows. A relatively thin, or narrow frame, usually square in shape, is attached to the upstream end of this pipe, as by bolting, welding or other attachment means. This frame is made by cutting, bending and interconnecting numerous individual frame sections to form an inflexible, square, slotted gate receptacle. Fitted into a slot defined within the frame is a flat gate member, usually made of wood or metal. A fabricated cleat, or handle, is usually attached to the top of the gate. It is secured to the flat gate section and is adapted to be grasped by hand for raising or lowering the gate, and so as to expose the major section of the pipe to water flow, or to cover the entire diameter the pipe, thereby preventing the flow of water through that pipe. Headgates so constructed are heavy, structurally complicated, overly large, difficult to install, subject to damage and expensive.

DISCLOSURE OF INVENTION

The present invention comprises a water control and diversion headgate of the general character and for the functional purpose described above; however, in this invention the various components are constructed so as to greatly simplify the design and to materially reduce the cost to the end user of the resulting units, to greatly improve the overall effectiveness of the system, and to thereby encourage a more extensive use of water control and diversion gates.

A primary component of the invention is a non-metallic corrugated pipe for accepting the flow of water therethrough. This pipe is constructed from a tough, weather-resistance, and somewhat resilient material. A slot, extending partially through the pipe, is defined at some distance from the inlet end of the pipe. This slot extends from the uppermost extremity of the pipe to just less than half way through it, almost across its major diameter. Positioned within the slot is a flat gate member (sometimes referred to hereafter as "gate"), vertically movable for blocking some or all of the pipe interior and for thereby controlling or stopping the flow of water through the pipe. The edges of the gate are beveled on both sides to provide easy entrance into the slot and a press fit where the sides of the gate contact the portions of the semi-resilient pipe which are less than the full pipe diameter. The resulting interference fit provides an efficient seal in this region, readily holding the gate in its set position.

The gate is fabricated from a rigid or a semi-resilient material, its lower end being shaped to match, or nearly match, the shape of the internal surface of the pipe in a nesting or a line-contacting relationship, preferably the latter. Thus, as water flows into the pipe and into contact with the gate it exerts a hydraulic force upon the gate. This, in turn, forces the edges of the gate against an adjacent surface of a pipe corrugation. The result is a very positive, automatic and virtually complete seal between these two components. It will be understood, therefore, that this combination of a semi-resilient pipe, with its described features, together with those more specific features described relative to the gate, results in the noted unique, automatically operating and substantially water-tight headgate assembly of this invention.

The gate is made long enough to extend upward through the slot and externally above the pipe. It is provided with grasping means whereby the gate may be raised from its seated position or lowered to its closed position easily and accurately. This ease of relative movement is important to the user of the headgate, and it results naturally from the characteristics of the materials used in its manufacture.

Therefore, a principal object of this invention is to provide a new and improved water divergent headgate for use principally in irrigation systems, and wherein the construction, sealing efficiency and utilization are enhanced and simplified, while the size, weight and cost are significantly less than in prior art devices.

Another objective is to provide a water divergent and control gate, and a method for manufacturing the same, wherein a water flow pipe section and a control gate are fabricated from standardized and readily available materials, are light in weight, relative flexible and capable of being worked easily for fabrication purposes.

Another objective is to provide means defining a water headgate assembly in which a pipe section is constructed to accept a gate member across its diameter, the combination having sufficient flexibility to provide a substantially water-tight seal when the gate is closed and water is introduced into the upstream end of the pipe, the gate having sufficient strength to accept and transmit the hydraulic loads on the closed or partially closed gate to the sealing surface of the corrugated pipe.

Yet another objective is to provide means and methods for fabricating a water distribution headgate wherein the materials are selected to produce a system wherein the ease of construction is maximized, the cost is minimized and the full utilization of a headgate by end users is made more attractive.

Another objective is to provide a water distribution headgate constructed at least primarily from semi-resilient materials which resist failure from contact by mechanical equipment or animals that could bend the headgate (as with metal components) or crack them (as with concrete components), thereby rendering them inoperable.

A further object is to provide a second embodiment of the invention in which pipe strength and water flow characteristics are enhanced through the use of a liner integral with or bonded to the inside of the corrugated pipe.

Other objects of invention will become apparent upon examination of the accompanying specification, claims and drawings, which provide a detailed description and functional explanation of the invention.

DESCRIPTION OF THE PREFERRED EMBODIMENT

Figure 1:
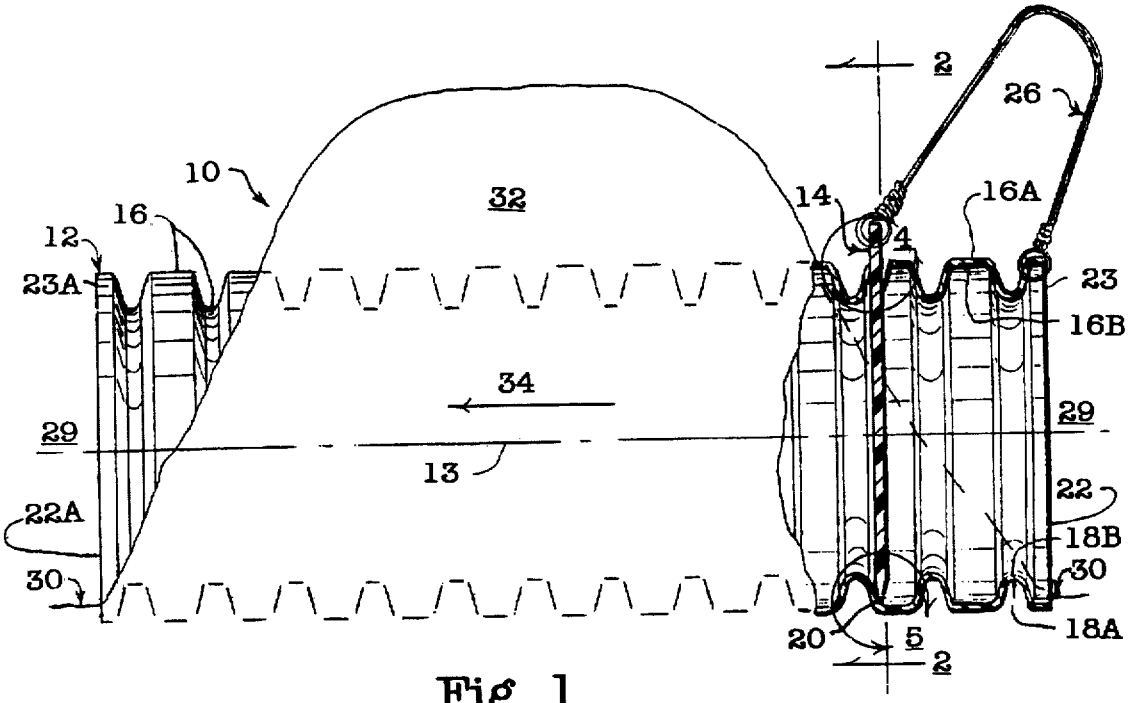
FIG. 1 is an elevational view partially in section and partially cut away to best illustrate the invention in its assembled condition and in its installed environment.

The water diversion headgate of this invention, as illustrated in the drawings, shows the respective parts identified by the same numbers throughout the drawings.

The entire headgate assembly is generally indicated by the numeral 10. Its primary components comprise a pipe 12 and a gate member 14 having a sealing edge 15.

The pipe 12 is fabricated from an appropriate length of corrugated pipe. Each of the multiplicity of corrugations is typically indicated by the numeral 16. The major outside diameters of such corrugations are identified by the numeral 16A and their major inside diameters by the numeral 16B. The minor outside diameter of such corrugations is indicated by the numeral 18B, with the minor inside diameter being shown as 18B.

Although the width and depth of the corrugations are not critical to the invention, their configuration provides a modest flexibility, which aids in the proper sealing of the gate 14 when in its installed position in the pipe 12. They are also of sufficient thickness to provide the strength necessary for structural and operational integrity.

It is desirable and preferred that the material from which the pipe 12 is manufactured be of a strong, yet modestly flexible material and that it be capable of maintaining its strength and long-life characteristics over an extended time, and this while being continuously exposed to air, water, sunlight, heavy equipment, large animals and other environmental stresses. It should, for example, also be chafe-resistant, so as to resist wear and tear from the traverse through its length of dirt, sand, rocks and other debris to which such pipes are normally exposed during irrigation procedures. It has been found that polymers such as polyethylene and polypropylene, are acceptable and appropriate for this purpose. Other materials having like chemical and/or physical characteristics may also be acceptable.

Figure 2:
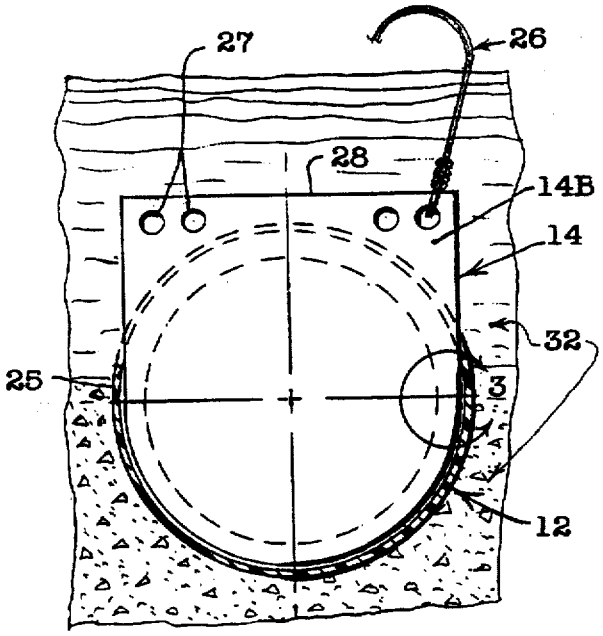
FIG. 2 is a sectional view taken along line 2—2 of FIG. 1, showing a water diversion gate in elevation and as installed in a pipe.

The pipe 12, as shown in FIG. 2, is usually round in cross section (as opposed to a square or rectangular cross section, for example) since this configuration is economical to purchase, readily available on the open market, and not readily susceptible to mechanical or hydrodynamic damage.

The length of the pipe 12, while not critical to the function of the invention, should be long enough to provide the desired structural stability and resistance to leakage between the pipe and the surrounding soil when installed, but short enough to minimize the loss of water pressure head during operation. It is also of importance, of course, that the cost be kept at a minimum by limiting the pipe length commensurate with operational efficiency.

It is additionally important in achieving the best operational results that the pipe inlet end 22 and the outlet end **22*a* be terminated such that flanges, as shown at 23 and 23A are formed by cutting through the major diameter of a pipe corrugation 16, preferably about half way through the outer portion of the corrugations, as seen in FIG. 1. This provides what may be described as a bell-shaped entrance and exit, also respectively represented by the numerals 23 and 23A**. These bell-shaped portions provide the desirable results of minimizing entrance and exit losses, thereby enhancing water flow capacity.

Figure 3:
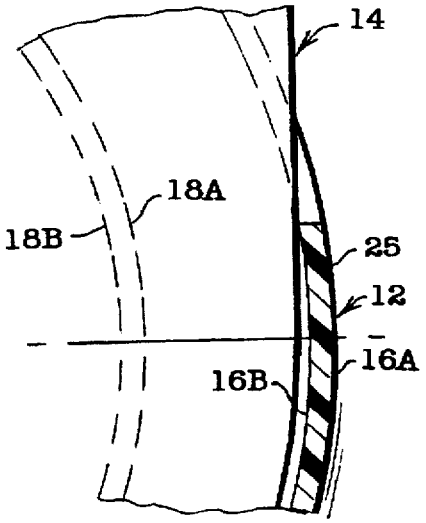
FIG. 3 is an enlarged sectional view taken from the circular line 3 of FIG. 2.
Figure 4:
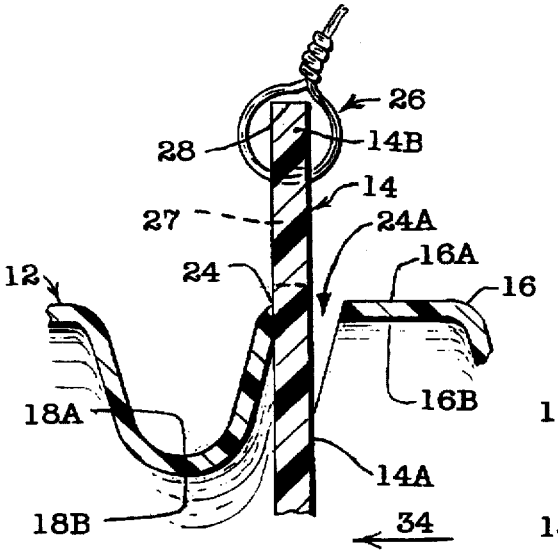
FIG. 4 is a an enlarged section taken from the circular line 4 of FIG. 1.
Figure 4A:
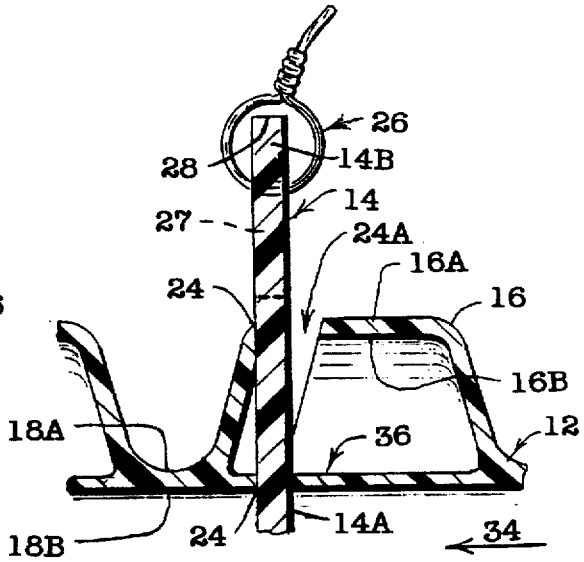
FIG. 4A is a view similar to FIG. 4, taken from the same position as FIG. 4, but illustrating a second or alternative embodiment of the invention.

A few corrugations downstream from the inlet end 22 of the pipe 12 a slot 24 is cut through the edge of one of the corrugations 16. It extends downward almost through the upper one half of the pipe. The purpose of this slot 24 is to provide a flexible receptacle for the gate 14. As best illustrated in FIGS. 4 and 4A, it will be noted that the entrance to the slot 24 is notched, as at 24A, on the upstream side of the gate. The slot then extends downward to encompasses slightly less than the full inside major diameter 16B of the pipe 12, i.e., it terminates just less than half way through the pipe (See FIGS. 2 and 3). Two pipe segments 25 (one on each side) border the slot 24 to provide a minor flexibility and an interference fit with the gate 14, an important feature of this invention for purposes to be described. The pipe flexibility, nevertheless, permits the slot 24 to accept the full width of the gate 14.

The slot 24 is also prepared so that it is just slightly less in thickness then the thickness of gate 14. Again, this assists in providing an interference fit between the gate 14 and the slot-defining structure, further holding the gate firmly (but in a flexibly restrained manner) in its installed position within the slot. Further assurance that the gate can be positioned and secured to partially block the pipe interior, and the water flow, is achieved by partially removing the gate, then cocking it sideways. This provides a quick and easy method for regulating water flow through the pipe.

As a minor aspect of the invention, a lanyard 26 (see FIG. 2), of any convenient length, may be attached to both the gate 14 and the pipe 12. This further obviates the possibility of losing the gate when it is removed, as well as providing a means to pull the gate from its water-blocking position, particularly when the gate is under water.

The gate 14, the elevation view of which is best seen in FIG. 2, may be made from the same material as or a similar material to that of the pipe 12. It has been found through research and tests, however, that the preferred material for this purpose is polypropylene. It provides the desired stiffness and chemical, mechanical and corrosion damage resistance. It is also easy to handle for manufacturing purposes. For example, its edges clean up easily subsequent to the gate being cut to its basic shape. The use of polypropylene also assures that the sealing edge 15 may be easily beveled for the purposes described below.

The second choice of material for the gate 14 is a high density polyethylene. It has most of the characteristics desirable for this application, but is too flexible for use in larger size gates. Hence, in some exceptionally large installations it is desirable to use galvanized steel or aluminum, primarily for strength and resistance to bending, although they still retain resiliency sufficient to accommodate the desired sealing against the resilient pipe corrugations. The major disadvantage of metal is that it is subject to bending damage by mechanical equipment and extraneous water-borne objects.

The gate 14 has a width approximating the major inner diameter 16B of the corrugations 16. This permits the gate 14 to be forced vertically into and through the slot 24, bottoming against or near the major inside diameter 16B of the pipe.

The lower or sealing edge 15 of the gate 14 is prepared to include a bevel, preferably about fifteen to thirty degrees, on each side of that edge, i.e., a double bevel. Such a bevel on the corrugation-contacting edge portion enhances the probability of obtaining a better line sealing contact than would be otherwise possible. Extensive tests have shown this sealing enhancement to be realistic and achievable. The tapered or beveled tip 15 of this edge also guides the gate into the slot and prevents the material of the pipe 10 from being cut by otherwise sharp edges.

As noted, it is preferable that both sides of the tip or edge 15 are beveled at approximately the same angle. This also permits the gate 14 to be installed with either of its sides facing downstream. Thus, a good line sealing contact may be made on either side of the gate with the same degree of efficiency, assuring that the gate may be picked up and installed quickly without concern for its orientation within the slot 24.

In summary, then, the double beveling of the edge 15 provides a four-fold benefit; a) it facilitates the easy entrance of the gate 14 into and through the slot 24, b) obviates potential problems of gate orientation, c) enhances the sealing capability of the assembly, and d) prevents the pipe 12 from being cut by sharp edges of the gate 14.

Additionally, as best seen in FIGS. 4, 4A, 5 and 5A, when the gate 14 is installed its downstream side is flush against the sealing side of the slot 24 and against the wall of the adjacent corrugation. Thus, when water pressure is exerted against the gate's upstream side 14A a positive hydraulic sealing force is applied to the mutually contacting surfaces of the gate 14, the slot 24 and the corrugation 16. This significantly enhances the ability of the assembly to prevent water leakage around the gate 14. The semi-flexible nature of the materials from which the components are made further enhances their sealability.

The width of the gate 14 is cut essentially the full width of the inside major diameter 16B of the corrugations 16, substantially filling the slot 24, slightly distending the side segments 25 to accomplish the above-described interference.

A portion 14B of the gate 14 extends upward a convenient short distance above the pipe 12. That distance is sufficient to facilitate the location of one or more holes 27 through the gate thickness near its upper edge 28, and such that the holes 27 will accept fingers therethrough for gate movement or removal, but assuring that enough material exists between the holes 26 and the upper edge 28 to provide the structural integrity required for pulling the gate upward, thereby partially or fully opening the gate without ripping or breaking the material near the upper edge 28.

When the above-described assembly is complete it is installed into a fully operational position within a ditch or channel. This is accomplished by preparing the channel, essentially as represented by the numeral 29 in FIG. 1, and by then placing the diversion gate assembly within the channel 29. The bottom 30 of that channel is usually maintained at or near the same level as the inside diameter of the pipe 12. The main body of the pipe 12 is then covered with dirt, as represented at 32 in FIG. 1. The dirt is packed in tightly, to hold the assembly in place within the channel. The channel 29 downstream of the pipe 12 is usually open, as in a conventional ditch, or as in a lateral from the main ditch.

Water entering the channel 29 in the direction of arrow 34 flows freely through the pipe 12 when the gate 14 is not positioned in the pipe. However, as the gate 14 is forced incrementally downward into the pipe 12 the water flow is gradually cut off, until the gate 12 reaches its complete downward position and the flow is stopped, as illustrated in FIG. 2 of the drawings. The hydraulic pressure of the water forces the gate 12 against the vertical walls of the slot 24 and the upstream side 20 of a corrugation 16. The result is an enhanced, substantially water-tight seal, as explained above. Additionally, as the gate 14 is moved downward the noted hydrodynamic forces tend to move the gate downstream through the pipe 12. The stiffness of the gate 14, together with the engagement of its edges with the corrugation walls, prevents the gate 14 from bending in a downstream direction, thereby also ensuring that it may be easily forced downward to fully close the gate.

Figure 5:
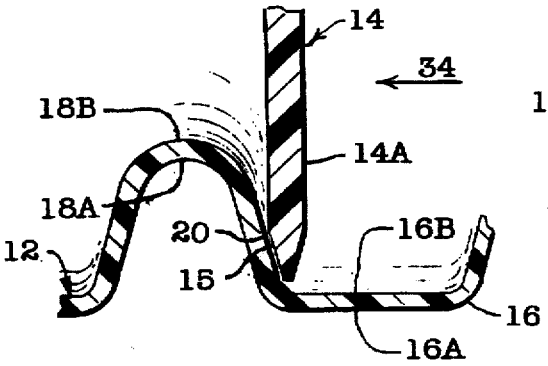
FIG. 5 is an enlarged sectional view taken from the circular line 5 of FIG. 1.
Figure 5A:
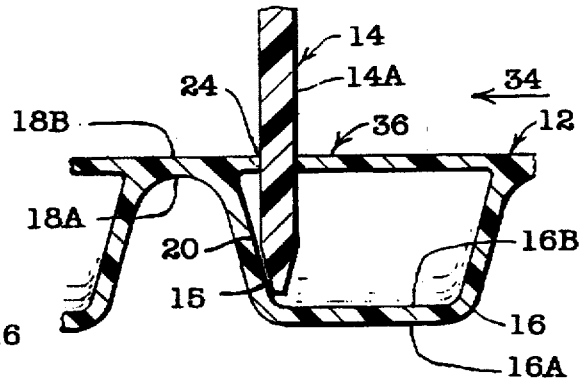
FIG. 5A is a view similar to FIG. 5, taken from the same position, but illustrating the second embodiment.

Concerning the second embodiment of the invention, as illustrated in FIGS. 4A and 5A, the present tendency within .the water pipe manufacturing industry is to provide corrugated pipes of the kind described above, but additionally containing a central liner member 36. This liner 36 is usually fabricated as an integral structural member with the corrugations 16, essentially as shown, through the application of heat and pressure. The reason for this change is to provide for better water flow characteristics, by virtue of the smooth inner surface of the liner 36, and for additional pipe strength. As shown and described above, the manufacturing method and the components of this invention are easily adaptable to this alternate pipe configuration. The slot 24 is simply cut through both a corrugation 16 and its adjacent or integral liner 36. It has been found that the use of a circular disc grinder, as opposed to a saw, to cut through the plastic members greatly improves the manufacturing process, from both speed and quality standpoints. Such a procedure leaves no ragged edges to be dealt with at a later time.

It will be apparent that certain basic equivalents in the configuration described above may be carried into effect without departing from either the spirit or scope of the invention, the intent being that so long as a corrugated pipe configured substantially as described is utilized with a gate of the nature also described it will be within the scope of this invention.

I claim:

1. A water divergent headgate comprising:

a length of pipe having a central longitudinal axis and a multiplicity of corrugations along its length, and adapted for installation within a water flow channel;

means in one of said corrugations defining a slot having a pre-defined width, extending almost half the way through a vertical diameter and across slightly less than the entire horizontal diameter thereof;

a gate member having a height greater than the diameter of said pipe, a width substantially the same as a major inside diameter of said corrugations and a thickness at least equal to the width of said slot means, said gate member being positioned within said slot means for movement normal to the length of said pipe and adapted to alternatively block and to open the interior of said pipe to the flow of water therethrough.

2. The headgate of claim 1 wherein said corrugations extend along the entire length of said pipe and each individual corrugation is shaped in cross section substantially as a truncated cone with rounded corners.

3. The headgate of claim 2 wherein each said corrugation includes upstream and downstream side portions;

said slot means is defined in one of said corrugations adjacent one of said downstream portions; and said gate member has a thickness slightly greater than the predefined width of said slot means and a width slightly greater than the horizontal width of said slot means.

4. The headgate of claim 3 wherein said slot means on lateral sides of said pipe terminate above a horizontal center line of said pipe such that a segment of said pipe adjacent said slot means extends laterally inward to partially close said slot means and so as to accommodate the receipt of said gate member in a flexibly retained relationship.

5. The headgate of claim 3 wherein said slot means at an upper extremity thereof is notched for easy receipt of said gate into said slot means.

6. The water divergent headgate of claim 1 wherein a smooth-walled inner liner is positioned internally of said corrugations in fixed contact therewith to enhance the flow of water through said pipe and strengthen the same, and said slot means extends through said liner.

7. The headgate of claim 6 wherein said liner is integrated with said corrugations.

8. The water control and divergent means of claim 6 wherein said pipe is made from polyethylene and said gate is made from polypropylene.

9. The headgate of claim 1 wherein said pipe is made of polyethylene and said gate is made from polypropylene.

10. The headgate of claim 1 wherein the edges of said gate are rounded to provide a single line sealing contact between said gate and its adjacent pipe corrugation.

11. A method for manufacturing a water divergent headgate comprising:

preparing a predetermined length of pipe, including at least one corrugation, wherein one such corrugation has a substantially square cross section having side walls and is manufactured from a material selected from the group consisting of polyurethane, polyethylene and polypropylene;

cutting a slot of finite width almost half way through a vertical diameter and across slightly less than the entire horizontal diameter of said one corrugation;

shaping a flat piece of material defining a water-blocking gate member having a composition similar to that of said pipe, a thickness slightly greater than the finite width of said pipe slot, a width slightly greater than the width of said pipe slot, and a length greater than the diameter of said pipe, and such that a first end of said gate extends beyond the said pipe when inserted fully into the slot and a second end is contoured to substantially match the internal periphery of said one corrugation and have a rounded external surface, and inserting the second end of said gate member into the slot and through said pipe until said second end contacts the internal periphery of its mating corrugation and a side of said gate member contacts said side wall adjacent to said slot in a line contact.

12. The method as defined in claim 11 and alternatively selecting galvanized steel as the material for said gate.

13. The method as defined in claim 11 and alternatively selecting aluminum as the material for said gate.

14. Means for controlling and diverting the flow of water through an irrigation channel comprising:

a length of plastic pipe having corrugation-defining means of substantially round cross section incorporated therein and having an upstream and a downstream end;

slot means partially through a major diameter of one of said corrugations intermediate of said pipe ends, said slot means being defined adjacent one wall of that corrugation and including means at its entrance into the corrugation means defining a notch in an upstream side thereof;

a substantially flat gate member contained partially within said slot means and movable therein to control the flow of water through said pipe, said gate means being fabricated from materials selected from that group known as chemical and corrosion resistant polymers.

15. A water divergent headgate comprising:

a length of pipe adapted for installation within a water flow channel, said pipe having a central longitudinal axis and at least one corrugation intermediate its ends, means in one said corrugation defining a slot having a pre-defined width, extending almost half the way through a vertical diameter and across slightly less than the entire horizontal diameter thereof;

a gate member having a height greater than the diameter of said pipe, a width substantially the same as a major inside diameter of one said corrugation and a thickness at least equal to the width of said slot means, said gate member being positioned within said slot means for movement normal to the length of said pipe and adapted to alternatively block and to open the interior of said pipe to the flow of water therethrough.

* * * * *